US005678684A

United States Patent [19]

Wright

[11] Patent Number: 5,678,684

[45] Date of Patent: Oct. 21, 1997

[54] CONTAINER FOR LIQUIDS

[75] Inventor: Robert T. Wright, Nazareth, Pa.

[73] Assignee: Binney & Smith Inc., Easton, Pa.

[21] Appl. No.: 514,150

[22] Filed: Aug. 11, 1995

[51] Int. Cl.[6] ..... B65D 51/18

[52] U.S. Cl. ..... 206/204; 206/1.8; 220/731

[58] Field of Search ..... 206/1.8, 204; 220/4.01, 220/4.12, 4.13, 4.16, 4.28, 729, 731, 734, 580, 578

[56] References Cited

U.S. PATENT DOCUMENTS

| | | | |
|---|---|---|---|
| 596,485 | 1/1898 | Dickerman . | |
| 1,254,714 | 1/1918 | Mccombs . | |
| 1,815,569 | 7/1931 | Johnson | 220/580 X |
| 2,627,619 | 2/1953 | Gagen | 15/121.3 |
| 3,322,308 | 5/1967 | Foster | 222/480 |
| 3,323,671 | 6/1967 | Minarik, Jr. et al. | 15/40 |
| 3,407,429 | 10/1968 | DiNardo | 15/257 |
| 3,464,599 | 9/1969 | Meth | 222/589 |
| 3,469,732 | 9/1969 | Foster | 220/31 |
| 3,542,261 | 11/1970 | Greenberg | 222/576 |
| 3,675,812 | 7/1972 | Foster | 220/31 S |
| 4,101,046 | 7/1978 | Puntillo | 220/90 |
| 4,106,672 | 8/1978 | Tecco et al. | 222/151 |
| 4,125,210 | 11/1978 | Embree | 222/570 |
| 4,209,100 | 6/1980 | Uhlig | 215/216 |
| 4,316,560 | 2/1982 | Carter | 222/567 |
| 4,361,250 | 11/1982 | Foster | 220/266 |
| 4,394,144 | 7/1983 | Aoki | 206/204 X |
| 4,607,768 | 8/1986 | Taber et al. | 222/556 |
| 4,621,744 | 11/1986 | Foster | 220/270 |
| 4,693,399 | 9/1987 | Hickman et al. | 222/480 |
| 4,714,174 | 12/1987 | Williams | 220/90 |
| 4,807,768 | 2/1989 | Gach | 215/216 |
| 4,890,807 | 1/1990 | Desjardins | 248/146 |
| 4,898,292 | 2/1990 | VerWeyst et al. | 215/237 |
| 5,271,519 | 12/1993 | Adams et al. | 220/375 |
| 5,273,182 | 12/1993 | Laybourne | 220/740 |

OTHER PUBLICATIONS

Six photographs of a container with a blue lid in assembled and disassembled positions, Battat © 1992.

Six photographs of a container with a red lid in assembled and disassembled positions, Jack Richeson & Co., Inc. available to applicant in approximately Nov. 1992.

*Primary Examiner*—Jacob K. Ackun

*Attorney, Agent, or Firm*—Leydig, Voit & Mayer, Ltd.

[57] ABSTRACT

The present invention provides a virtually spill-proof container for use with paint or liquids of comparable viscosity. In particular, the container of the present invention comprises a receptacle having a base portion and a top portion, an insert member with a generally central aperture attached to the top portion of the receptacle, and a barrier member having a hole formed therethrough operatively connected to the insert member. The hole in the barrier member permits a user to access the liquid within the container with a brush or like instrument, while the barrier member functions like an obstruction which prevents, or minimizes, spillage should the container be tipped over or inverted. The barrier member may alternatively be constructed of an absorbent sponge or solid plastic material. A lid is also provided so that the user may conveniently open and reseal the container.

49 Claims, 7 Drawing Sheets

CONTAINER FOR LIQUIDS

FIELD OF THE INVENTION

The present invention relates generally to containers and, more particularly, concerns a virtually spill-proof container for use with paint or liquids of comparable viscosity which prevents, or minimizes, spillage should the container be tipped over.

BACKGROUND OF THE INVENTION

A variety of containers are known in the art for holding liquids such as paints, colored dyes, inks, and the like. Such containers, however, are easily spilled, and once spilled, the liquid contained therein can readily flow from the container and create a mess. Thus, it is generally desirable to provide a container which prevents, or minimizes, spillage should the container be tipped over or inverted. When used by children, such a container would be especially advantageous.

OBJECTS OF THE INVENTION

Accordingly, the primary object of the present invention is to provide a virtually spill-proof container.

A more detailed object of the present invention is to provide a virtually spill-proof container for use with paint or liquids of comparable viscosity.

An even more detailed object of the present invention is to provide a container which prevents, or minimizes, spillage should the container be tipped over or inverted.

Another object of the present invention is to provide a virtually spill-proof container which is relatively simple in construction and cost effective to produce.

A further object of the present invention is to provide a virtually spill-proof container which is reliable, convenient, and simple to use.

SUMMARY OF THE INVENTION

The present invention accomplishes these objectives by providing a container having an internal barrier member. In use, the barrier member functions like an obstruction which prevents, or minimizes, the amount of paint that will spill should the container be tipped over.

In particular, the container of the present invention includes a receptacle for housing the paint, an insert member, and an internal barrier member operatively connected to the insert member and arranged within the receptacle. More specifically, the receptacle has a base portion with a bottom surface and a top portion with an opening. The insert member has an outer surface, an inner surface, and a generally central aperture and is removably attached to the top portion of the receptacle. The insert member is attached to the top portion of the receptacle such that the outer surface projects away from the bottom surface of the receptacle while the inner face projects toward the bottom surface of the receptacle. The barrier member has a first end, which is operatively connected to the inner surface of the insert member, a second end, which extends into the receptacle, and a hole between the first and second ends. The barrier member may alternatively be constructed of an absorbent sponge material or a solid plastic material. A lid is also provided so that the container may be conveniently opened and resealed.

Other embodiments are also provided which offer refinements to and variations of the basic design. In the embodiments, a gap should exist between the bottom surface of the receptacle and the second end of the barrier member so that a paint brush can be inserted through the hole in the barrier member and reach the paint residing in the base portion of the receptacle.

These and other features and advantages of the invention will become apparent upon reading the following description of the invention, and upon reference to the accompanying drawings.

While the invention will be described and disclosed in connection with certain embodiments and procedures, it is not intended to limit the invention to those specific embodiments. Rather it is intended to cover all such alternative embodiments and modifications as fall within the spirit and scope of the appended claims.

DETAILED DESCRIPTION OF THE INVENTION

Figure 1:
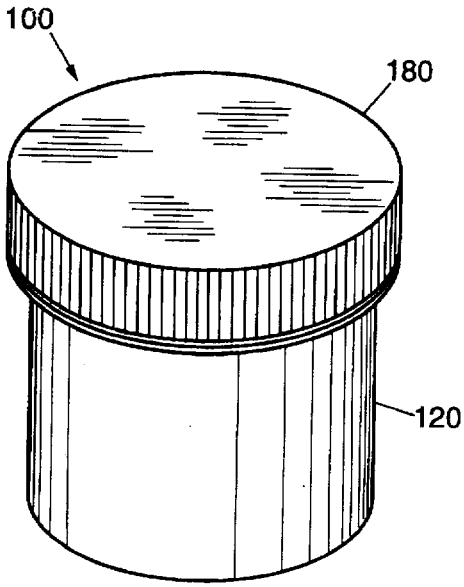
FIG. 1 is a perspective view of a first embodiment of a container constructed in accordance with the present invention.
Figure 2:
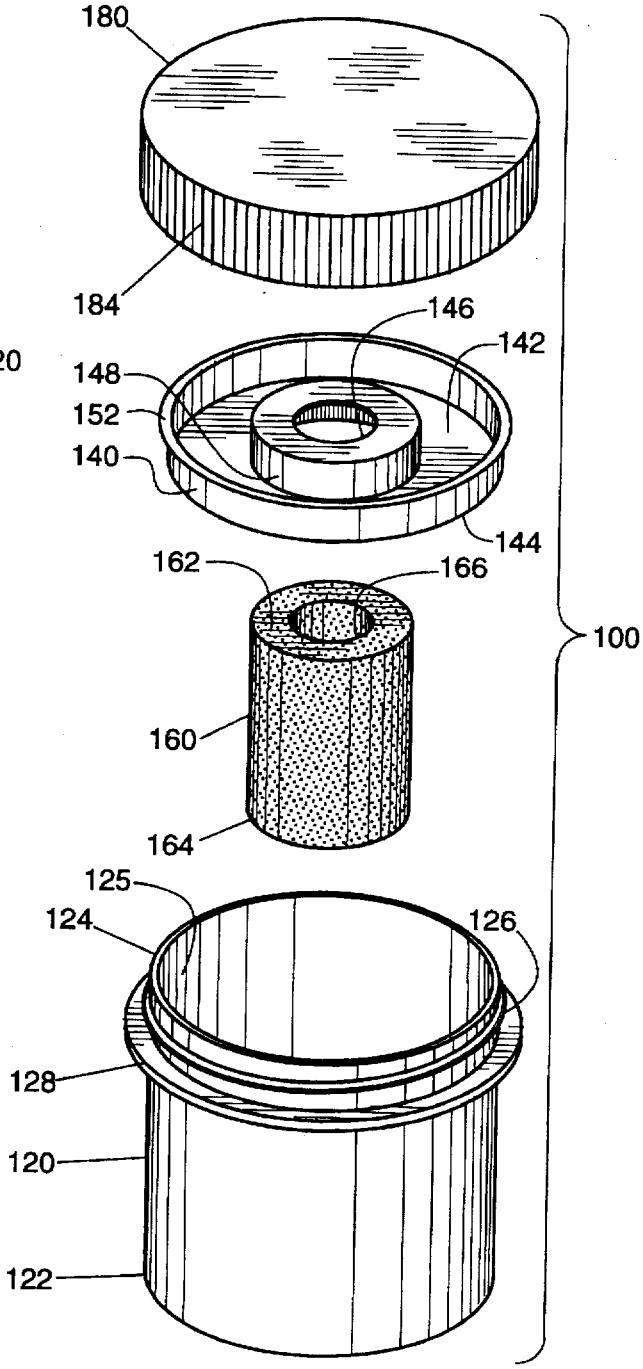
FIG. 2 is an exploded perspective view of the container depicted in FIG. 1, wherein a receptacle, an insert member, a barrier member constructed from a sponge material, and a lid are more clearly shown.

A first embodiment of a container 100 constructed in accordance with the teachings of the present invention is shown generally in FIGS. 1 through 4. As best shown in FIG. 2, the container 100 comprises a receptacle 120, an insert member 140, and a barrier member 160.

The receptacle 120 of the first embodiment is generally cylindrical in shape and is configured to receive and hold viscous liquids such as paint. In particular, the receptacle 120 includes a base portion 122 comprising a bottom surface 123, and a top portion 124 which defines an opening 125 through which paint can be deposited. The top portion 124 also includes a threaded engagement feature 126, disposed around the outer periphery of the receptacle 120, and an outward flange 128, positioned directly underneath the threaded engagement feature 126. Preferably, the receptacle 120 of the first embodiment is manufactured from injection molded plastic and can hold approximately four ounces of paint.

The insert member 140 of the first embodiment is generally disk-like in shape and is sized such that it is removably attachable to the top portion 124 of the receptacle 120. In accordance with an important aspect of the present invention, the insert member 140 has an outer surface 142, an inner surface 144, and an aperture 146 formed therethrough. Preferably, the outer and inner surfaces 142, 144 are non-planer and the aperture 146 is both circular and centrally located. However, in an alternative construction, the outer and inner surfaces 142, 144 of the insert member 140 could be planer (or flat) and the aperture 146 could be non-centrally located and/or non-circular in shape. For instance, the aperture 146 could, alternatively, be either oval, rectangular, or triangular in shape.

Figure 3:
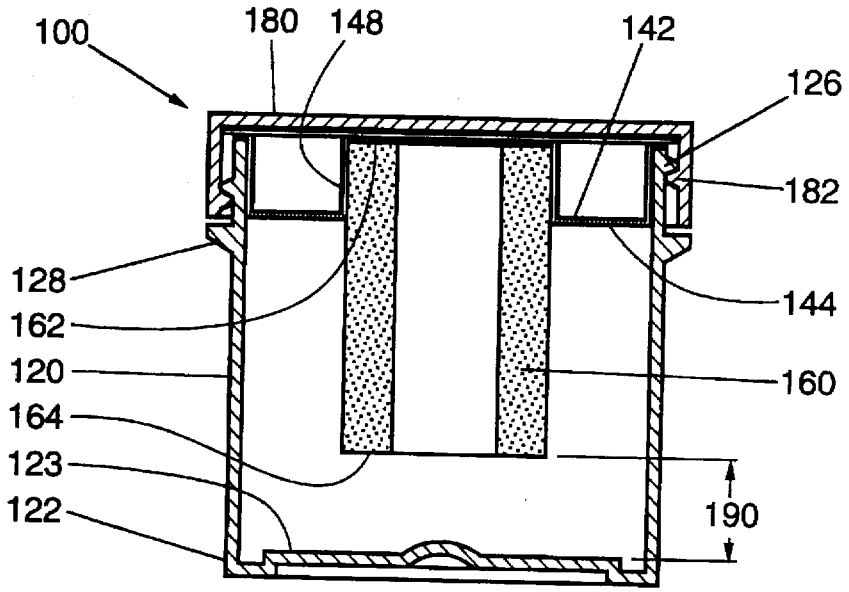
FIG. 3 is a cross-sectional view of the container depicted in FIG. 1, taken along line 3—3.
Figure 4:
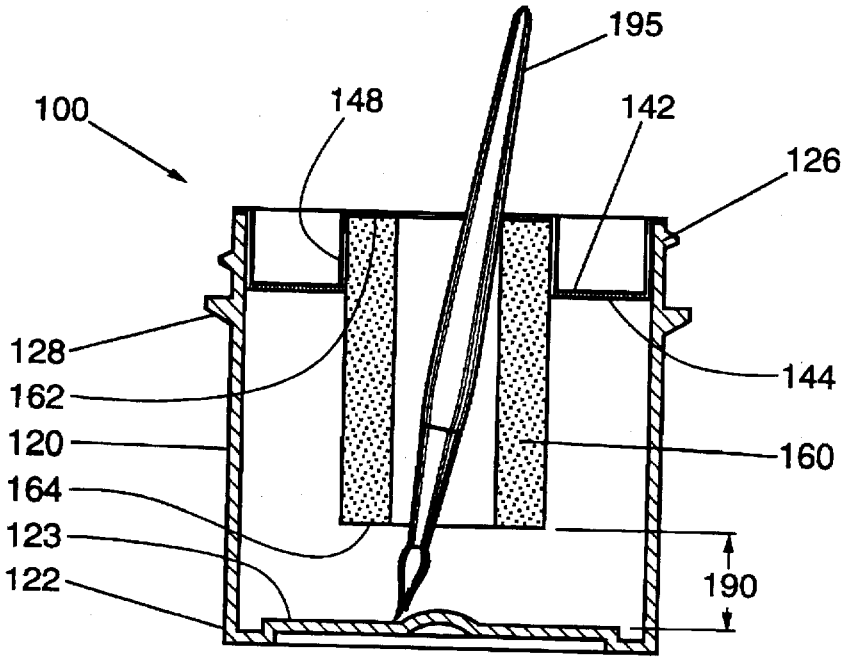
FIG. 4 is a cross-sectional view of the container depicted in FIG. 1, with the lid removed and a paint brush is inserted into the receptacle.

In the first embodiment, the inner and outer surfaces 142, 144 of the insert member 140 are parallel to one another and define a raised central circular portion 148. In accordance with another important aspect of the present invention, the central aperture 146 is formed through the raised central circular portion 148. A lip 152 formed around the periphery of the insert member 140 is also provided so that when the insert member 140 is assembled to the receptacle 120, the insert member 140 is prevented from being pushed past the plane that defines the top surface 124 of the receptacle 120. As shown in FIGS. 2 through 4, the insert member 140 is assembled to the top portion 124 of the receptacle 120 such that the outer surface 142 projects away from the bottom surface 123 of the receptacle 120 while the inner surface 144 projects toward the bottom surface 123 of the receptacle 120. In the first embodiment, the insert member 140 is made of thermoform molded plastic.

The barrier member 160 of the first embodiment is constructed from an absorbent sponge material and comprises a first end 162, a second end 164, and a hole 166 formed therethrough. As best shown in FIG. 2, the barrier member 160 is generally cylindrical in shape and has a circular cross-section. The barrier member 160 and hole 166, however, may have a different cross-section (including oval, rectangular, triangular, or other polygons), as long as it is fabricated of an absorbent sponge-like material. One especially suitable form of material for the barrier member 160 is an open cell sponge manufactured by TMP Technologies Inc., Truly Magic Products Division, 1200 Northland Avenue, Buffalo, N.Y., 14215-3825 under the part name "Yellow Ether 1330".

Properly assembled, the first end 162 of the barrier member 160 is operably connected to the inner surface 144 of the insert member 140 such that the hole 166 of the barrier member 160 is substantially aligned with the central aperture 146 of the insert member 140. Preferably, the first end 162 of the barrier member 160 is received by the raised central circular portion 148 of the insert member 140. The first end 162 of the barrier member 160 may also be affixed to the inner surface 144 of the insert member 140 with glue or a like substance.

As best shown in FIGS. 3 and 4, the barrier member 160 should have enough length so that a small gap 190 exists between the second end 164 of the barrier member 160 and the bottom surface 123 of the receptacle 120. In keeping with certain objects of the present invention, the gap 190 should not only allow a paint brush 195 to reach the paint at the bottom of the receptacle 120, as depicted in FIG. 4, but should also minimize spillage should the container 100 be tipped over. A gap 190 of ideal size achieves both of these goals. It will be readily appreciated by those skilled in the art that an ideal gap is dependent upon many factors, including the viscosity of the paint. As such, the size of the gap 190 can vary somewhat without departing from the scope or spirit of the present invention. Nevertheless, for a paint having a representative viscosity of four thousand centipoise, the gap 190, the barrier member 160, and the receptacle 120 should have the following dimensions: (1) the gap 190 can range from about ⅜ inch to ¾ inch and, ideally, should be ½ inch; (2) the internal and external diameters of the barrier member 160 should be roughly ½ and 1 inches, respectively; (3) the internal diameter of the receptacle 120 should be about 2 and ¼ inches; and (4) the height of the receptacle 120 should be about 2 inches.

In use, paint is retrieved from the bottom of the receptacle 120 by inserting the paint brush 195 through both the central aperture 146 of the insert member 140 and the hole 166 of the barrier member 160, as depicted in FIG. 4. Should the container 100 be inadvertently tipped over, however, the sponge barrier member 160 absorbs the paint before it can exit the container 100. Thus, the sponge barrier member 160 functions as an internal, absorbent obstruction which prevents, or at least minimizes, the amount of paint that will dribble out should the container 100 be accidentally tipped over or inverted.

As an added feature of the present invention, a removable lid 180 is also provided so that a user may readily open the container 100 and access the paint therein. As best shown in FIG. 3, the lid 180 of the first embodiment is screwably attached to the top portion 124 of the receptacle 120. In particular, the lid 180 has a threaded engagement feature 182 which screwably mates with the threaded engagement feature 126 of the receptacle 120. As such, the lid 180 can be removed from and attached to the receptacle 120 simply by turning the lid 180 in the proper direction. A plurality of serrated ridges 184, disposed on the outer periphery of the lid 180, facilitates gripping the lid 180. It should be understood by those skilled in the art that the lid 180 also provides a convenient means for resealing the container 100 after it has been opened.

Figure 5:
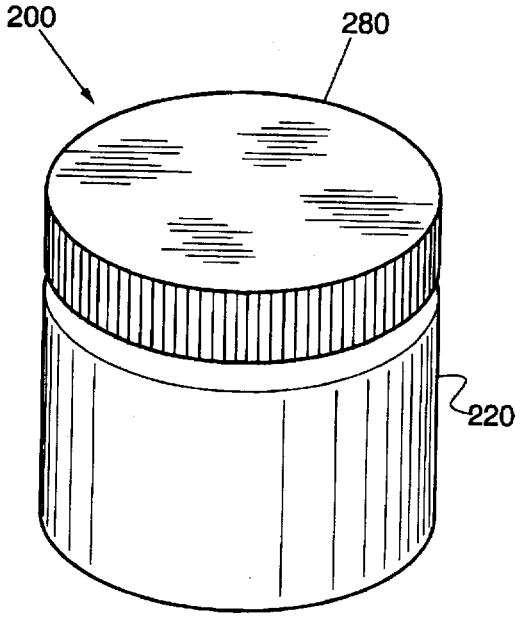
FIG. 5 is a perspective view of a second embodiment of the container, wherein the insert member has a plurality of protrusions.
Figure 6:
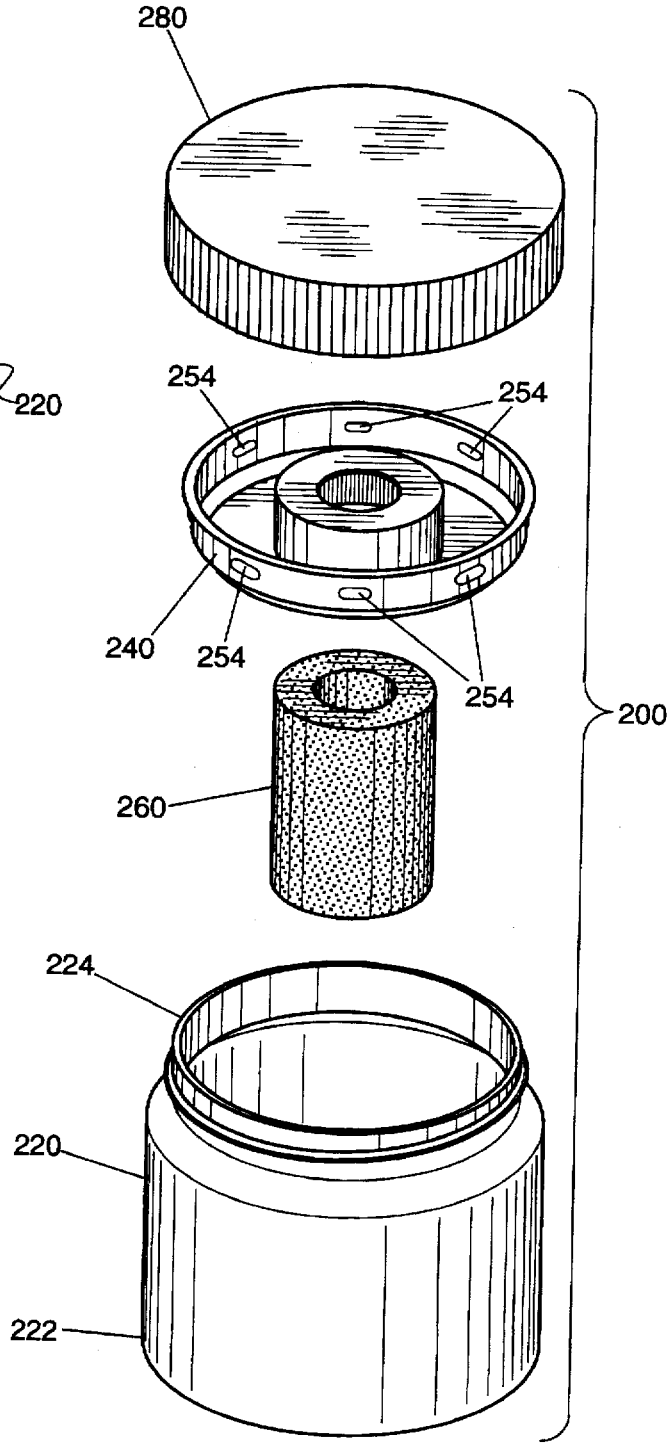
FIG. 6 is an exploded perspective view of the container depicted in FIG. 5, wherein the protrusions on the insert member are more clearly shown.

A second embodiment of the container 200 is illustrated in FIGS. 5 and 6. As in the first embodiment, the second embodiment of the container 200 comprises a generally cylindrical receptacle 220 having a base portion 222 and a top portion 224, an insert member 240 removably attachable to the top portion 224 of the receptacle 220, a sponge barrier member 260, and a screw-on lid 280. The second embodiment, however, provides some differences over the first embodiment—namely: (1) the receptacle 220 is manufactured from blow molded plastic; and (2) a plurality of outwardly projecting protrusions 254 are arranged about the outer periphery of the insert member 240 which are provided so that insert member 240 can be more securely attached to the top portion 224 of the receptacle 220. Aside from these differences, the construction and operation of the second embodiment of the container 200 are essentially the same as the first embodiment of the container 100.

Figure 7:
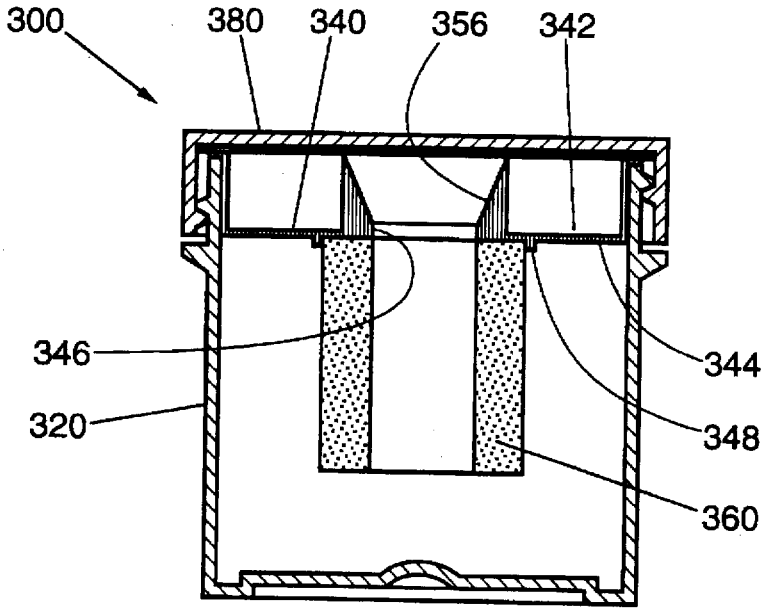
FIG. 7 is a cross-sectional view of a third embodiment of the container, wherein the insert member has a conical lead-in portion.

A third embodiment of the container 300, constructed in accordance with the present invention, is illustrated in FIG. 7. As in the first two embodiments, the third embodiment of the container 300 includes a receptacle 320, an insert member 340 having an outer surface 342, an inner surface 344, and a central aperture 346, a sponge barrier member 360 affixed to the inner surface 344 of the insert member, and a screw-on lid 380. In this particular embodiment the insert member 340 is constructed from injection molded plastic and includes a conical lead-in portion 356 which is aligned with the central aperture 346. As in the previous embodiments, a raised central circular portion 348, disposed on the inner surface 344 of the insert member 340, receives the sponge member 360.

Figure 8:
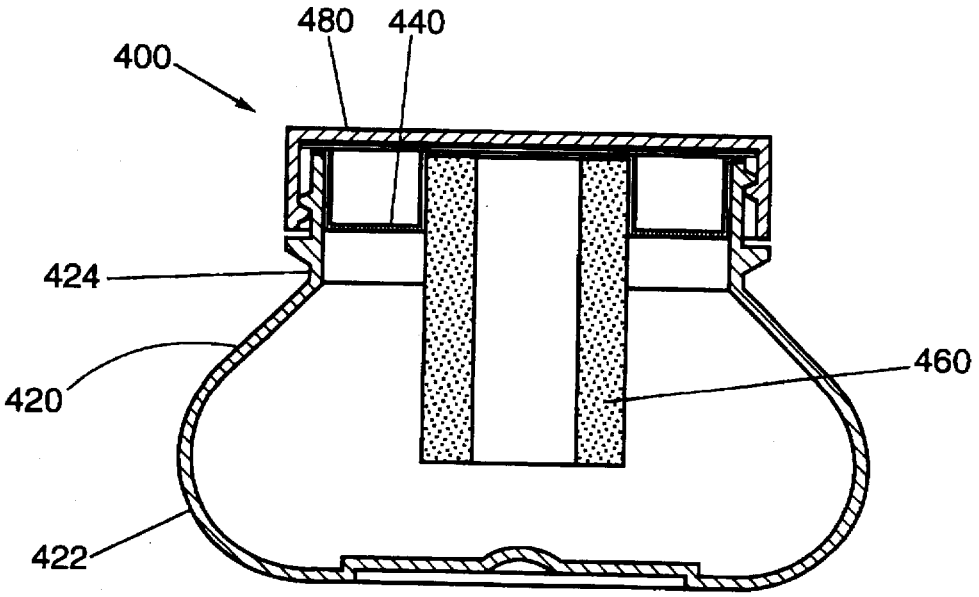
FIG. 8 is a cross-sectional view of a fourth embodiment of the container, wherein the receptacle has a wide bottom.

A fourth embodiment of the container 400 is depicted in FIG. 8. The fourth embodiment of the container 400 includes a receptacle 420 having a base portion 422 and a top portion 424, an insert member 440, a sponge barrier member 460, and a screw-on lid 480. Like the insert members 140, 240 of the first and second embodiments, the insert member 440 of the fourth embodiment is preferably constructed of thermoform molded plastic. More importantly, though, the base portion 422 of the receptacle 420 is noticeably wider than the top portion 424 of the receptacle 420. This particular shape advantageously provides the receptacle 420 with a lower center of gravity which helps prevent the container 400 from being tipped over or spilled.

Figure 9:
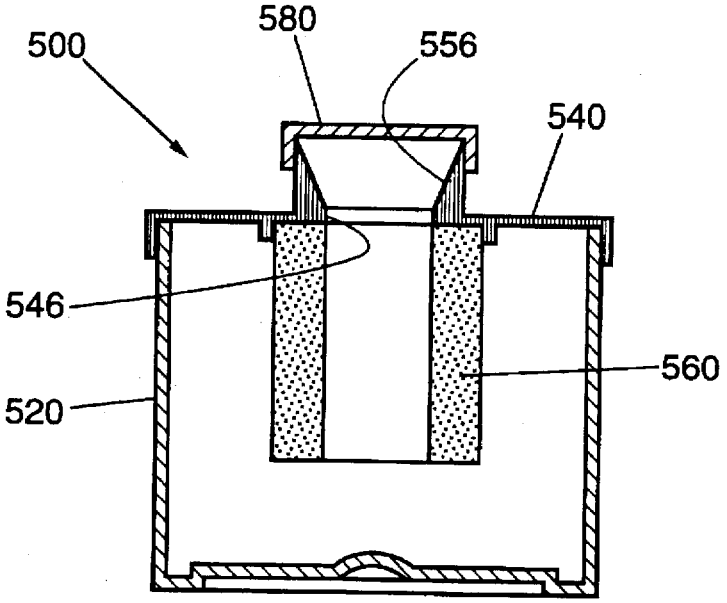
FIG. 9 is a cross-sectional view of a fifth embodiment of the container, wherein the lid is removably attached to the insert member.

A fifth embodiment of the container 500 is shown in FIG. 9. In particular, the fifth embodiment comprises a generally cylindrical receptacle 520, an injection molded plastic insert member 540 having a central aperture 546 with a conical lead-in portion 556, a sponge barrier member 560 affixed to the insert member 540, and a lid 580. Unlike the preceding four embodiments, though, the lid 580 of the fifth embodiment is smaller in size and is removably attached to the insert member 540. Specifically, the lid 580 fits over the conical lead-in portion 556 of the central aperture 546 of the insert member 540, as depicted in FIG. 9. Preferably, the lid 580 fits over the conical lead-in portion 556 of the insert member 540 with a snap-in-place or interference fit.

Figure 10:
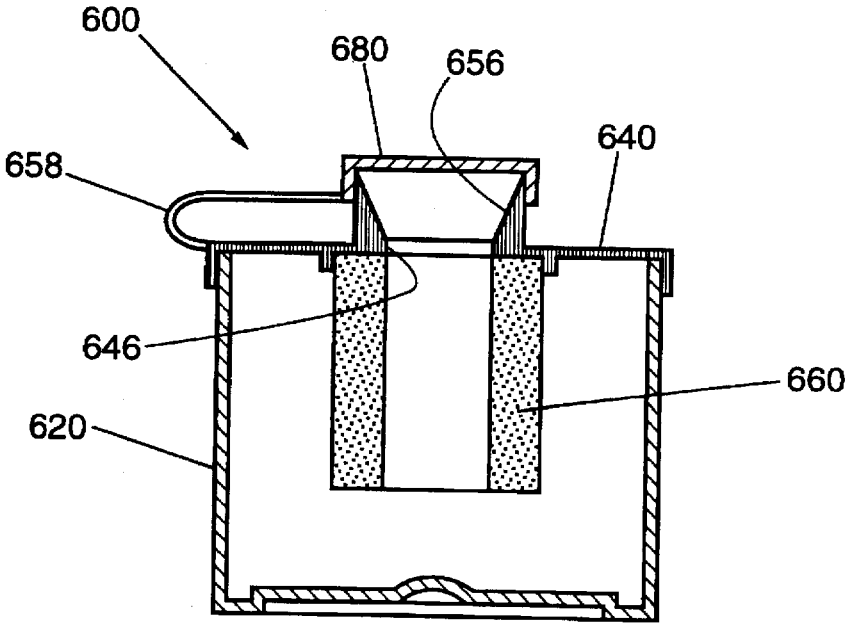
FIG. 10 is a cross-sectional view of a sixth embodiment of the container, wherein the lid is tethered to the insert member.

A sixth embodiment of the container 600 is illustrated in FIG. 10. Like the fifth embodiment, the sixth embodiment includes a generally cylindrical receptacle 620, an injection molded plastic insert member 640 having a central aperture 646 with a conical lead-in portion 656, a sponge barrier member 660 affixed to the insert member 640, and a lid 680 that fits over the conical lead-in portion 656 of the insert member 640. In addition, the lid 680 is tethered to the insert member 640 by way of a flexible retaining strip 658. In use, the flexible retaining strip 658 helps prevent the lid 680 from becoming misplaced or lost.

Figure 11:
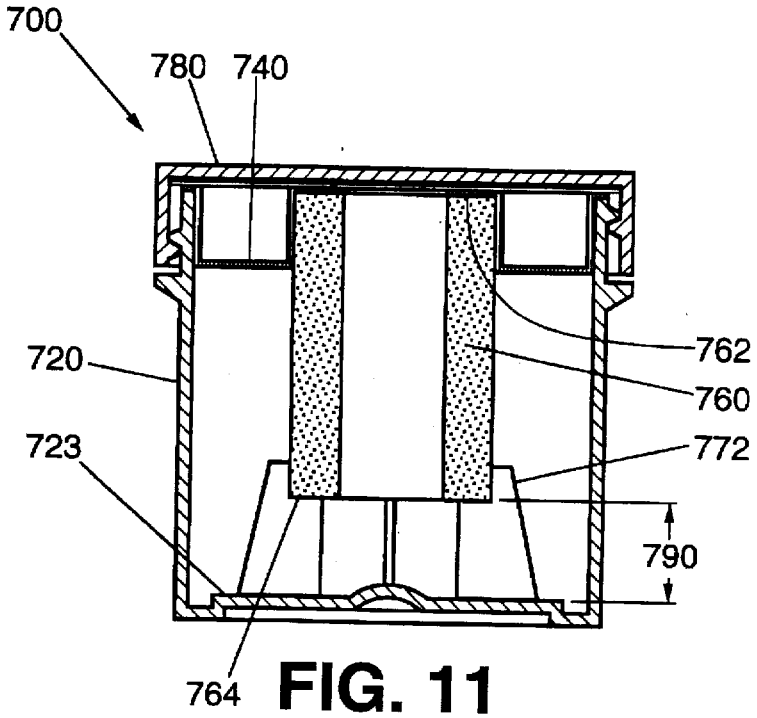
FIG. 11 is a cross-sectional view of a seventh embodiment of the container, further comprising a holding rib for the barrier member.

A seventh embodiment of the container 700, constructed in accordance with the teachings of the present invention, is shown in FIG. 11. As in the first and second embodiments, the seventh embodiment of the container 700 comprises a receptacle 720 having a bottom surface 723, an insert member 740 made of thermoform molded plastic, a sponge barrier member 760 having a first end 762 contacting the insert member 740, and a screw-on lid 780. In addition, the container 700 further comprises a holding rib 772, disposed on the bottom surface 723 of the receptacle 720, which keeps the second end 764 of the barrier member 760 spaced away from the bottom surface 723 of the receptacle 720, as shown in FIG. 11. Thus, when the holding rib 772 is used, it is not necessary to affix the barrier member 760 to the insert member 740. Moreover, the holding rib 772 assures that a properly sized gap 790 exists between the second end 764 of the barrier member 760 and the bottom surface 723 of the receptacle 720. Preferably, the holding rib 772 is integrally molded as part of the receptacle 720. However, the holding rib 772 could also be separately constructed from plastic, metal wire, or a like substance.

Figure 12:
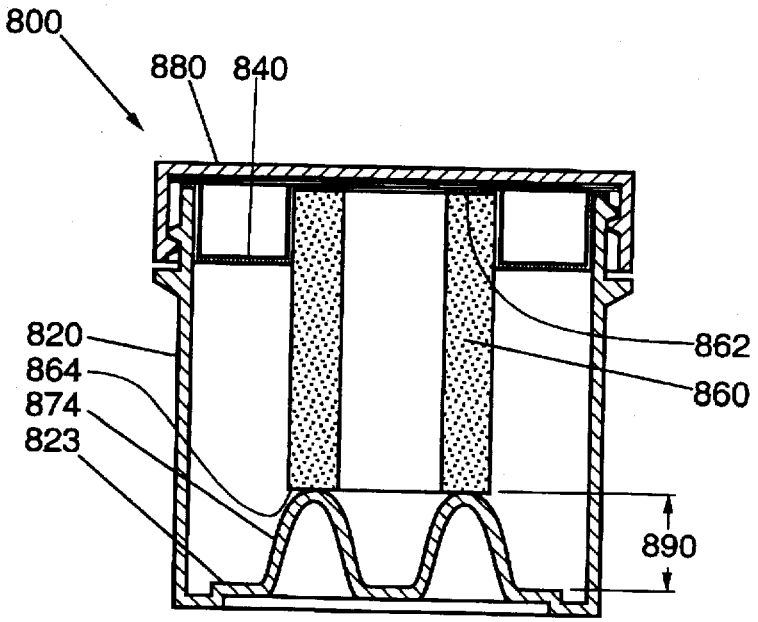
FIG. 12 is a cross-sectional view of an eighth embodiment of the container, wherein the receptacle has a raised spacer dimple for the barrier member.

An eighth embodiment of the container 800 is illustrated in FIG. 12. Like the seventh embodiment, the eighth embodiment of the container 800 includes a receptacle 820 having a bottom surface 823, an insert member 840 contacting the receptacle 820, a sponge barrier member 860 having a first end 862 attached to the insert member 840, and a screw-on lid 880. In addition, like the seventh embodiment, the eighth embodiment of the container 800 also has a means for assuring that a properly sized gap 890 exists between the second end 864 of the barrier member 860 and the bottom surface 823 of the receptacle 820. In particular, the second end 864 of the barrier member 860 is held apart from the bottom surface 823 of the receptacle 820 by a raised spacer dimple 874. Preferably, the raised spacer dimple 874 is integrally formed on the bottom surface 823 of the receptacle 820. A passage 876, formed by the raised spacer dimple 874 and the second end 864 of the sponge barrier member 860, provides an orifice through which paint may flow.

Figure 14:
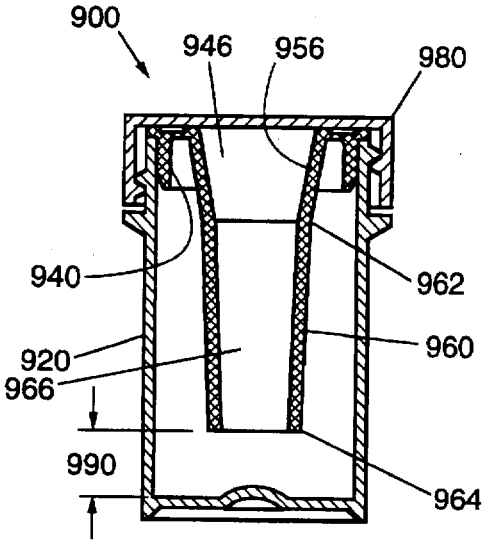
FIG. 14 is a cross-sectional view of the container depicted in FIG. 13.
Figure 13:
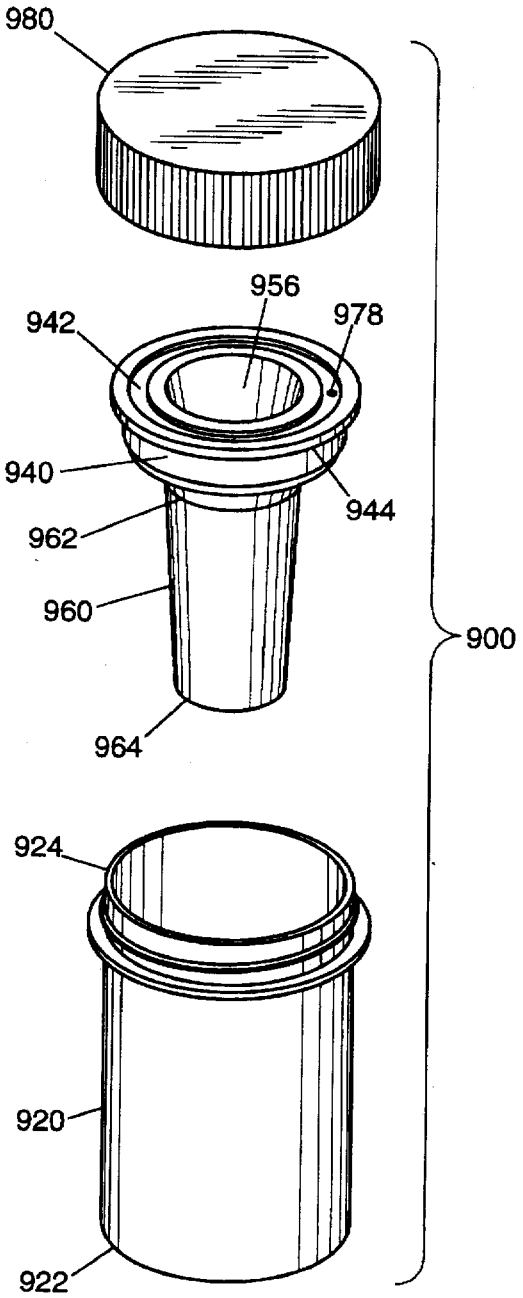
FIG. 13 is an exploded perspective view of a ninth embodiment of the container, wherein the barrier member is constructed of a solid material and the insert member and the barrier member are integrally formed.

A ninth embodiment of the container 900 is illustrated in FIGS. 13 and 14 and comprises a generally cylindrical receptacle 920, an insert member 940, a barrier member 960, and a screw-on lid 980. As in the previous embodiments, the receptacle 920 has a base portion 922 and a top portion 924; the insert member 940 has an inner surface 944, an outer surface 942, and an aperture 946 therethrough; and the barrier member 960 has a first end 962, a second end 964, and a tapered hole 966 therethrough. However, unlike the previous embodiments, the barrier member 960 of the ninth embodiment is constructed of solid plastic material. Moreover, the first end 962 of the barrier member 960 is preferably integrally formed on the inner surface 944 of the insert member 940, as shown in FIG. 13, by injection molding. The aperture 946 of the insert member 940 includes a conical lead-in portion 956, arranged adjacent to the first end 962 of the barrier member 960, which facilitates paint brush insertion. For a paint having a representative viscosity of four thousand centipoise, the gap 990, the barrier member 960, and the receptacle 920 should have the following dimensions: (1) the gap 990 can range from about ¼ inch to ½ inch and, ideally, should be ⅜ inch; (2) the internal and external diameters of the barrier member 960 should be roughly 0.4 and 0.5inches, respectively; (3) the internal diameter of the receptacle 920 should be about 1 inch; and (4) the height of the receptacle 920 should be about 2 inches. In addition, the receptacle 920 of the ninth embodiment has a total capacity of approximately 0.75 ounces which is appreciably smaller than the receptacles of the previous embodiments.

In keeping with an important aspect of the present invention, the insert member 940 of the ninth embodiment also includes one or more air vent holes 978 which allows air to enter the receptacle 920 during use. The presence of air in the receptacle 920 is important because it facilitates the flow of liquid up into the hole 966 of the barrier member 960 which permits the liquid to be more easily retrieved from the bottom of the receptacle 920. In previous embodiments, air entered the receptacle by passing through the inherently porous sponge barrier member. In the present embodiment, however, air cannot pass through the barrier member 960 because it is constructed of solid plastic material. Accordingly, one or more air vent holes 978 is required.

In practice, the air vent holes 978 should be small enough to prevent paint from leaking out during use, but should also be large enough to permit air to freely enter the receptacle 920. Although various sizes, locations, and numbers of air vent holes 978 may be used, an air vent hole 978 of 0.030 inch diameter is preferred for a paint having a viscosity of four thousand centipoise.

In summary, it will be appreciated by those skilled in the art that several embodiments of a unique and virtually spill-proof container for use with paint or liquids of comparable viscosity has been shown and described herein. In particular, the container of the present invention has an internal barrier member which functions like an obstruction to prevent, or drastically reduce, spillage should the container be overturned.

While several embodiments of the present invention have been shown, it will be understood, of course, that the present invention is not limited to these particular embodiments. Since modifications may be made to the embodiments disclosed herein, particularly in view of the foregoing teachings, without departing from the present invention, the appended claims are intended to cover all structures, regardless of modifications, that fall within the scope and spirit of the present invention.

What is claimed is:

1. A container for use with paint or liquids of comparable viscosity, the container comprising, in combination:

a receptacle for holding liquid, the receptacle having a base portion with a bottom surface and a top portion with an opening;

an insert member attached to the top portion of the receptacle, the insert member having an outer surface, an inner surface, and an aperture therethrough; and a barrier member having a first end, a second end, and a hole therethrough, the first end of the barrier member being operably connected to the inner surface of the insert member such that the second end extends downwardly into the receptacle and the hole is substantially aligned with the aperture of the insert member, the barrier member also having a length which provides a gap between the second end of the barrier member and the bottom surface of the receptacle, the gap being substantially less than the distance between the inner surface of the insert member and the bottom surface of the receptacle, the gap, the hole of the barrier member, and the aperture of the insert member providing access to liquid disposed in the receptacle but substantially inhibiting egress of liquid from the receptacle when the container is tipped over.

2. A container as defined in claim 1 wherein the barrier member is constructed of absorbent sponge material.

3. A container as defined in claim 2 wherein the first end of the barrier member is adhesively affixed to the inner surface of the insert member.

4. A container as defined in claim 1 wherein the barrier member is constructed of plastic material.

5. A container as defined in claim 4 wherein the first end of the barrier member is integrally formed on the inner surface of the insert member.

6. A container as defined in claim 1 wherein the barrier member has a generally circular cross-section.

7. A container as defined in claim 1 wherein the receptacle is constructed of plastic material.

8. A container as defined in claim 7 wherein the receptacle is injection molded.

9. A container as defined in claim 7 wherein the receptacle is blow molded.

10. A container as defined in claim 1 wherein the base portion of the receptacle is wider than the top portion of the receptacle.

11. A container as defined in claim 1 wherein the insert member is constructed of plastic material.

12. A container as defined in claim 11 wherein the insert member is thermoform molded.

13. A container as defined in claim 11 wherein the insert member is injection molded.

14. A container as defined in claim 13 wherein the insert member has a conical lead-in portion which is aligned with the aperture.

15. A container as defined in claim 1 wherein the insert member has a raised circular portion which receives the first end of the barrier member.

16. A container as defined in claim 1 wherein the insert member has a plurality of protrusions which engage the top portion of the receptacle.

17. A container as defined in claim 1 wherein the insert member has an air vent hole.

18. A container as defined in claim 1 wherein the second end of the barrier member is separated from the bottom surface of the receptacle by a holding rib.

19. A container as defined in claim 18 wherein the holding rib is constructed of plastic material.

20. A container as defined in claim 19 wherein the holding rib is integrally molded as part of the receptacle.

21. A container as defined in claim 1 wherein the second end of the barrier member is separated from the bottom surface of the receptacle by a raised spacer dimple arranged on the bottom surface of the receptacle.

22. A container as defined in claim 21 wherein the raised spacer dimple is integrally formed on the bottom surface of the receptacle.

23. A container as defined in claim 22 wherein the raised spacer dimple and the second end of the barrier member form a passage through which paint may flow.

24. A container as defined in claim 1, further comprising: a lid removably attached to the top portion of the receptacle.

25. A container as defined in claim 24 wherein the lid is screwably attached to the top portion of the receptacle.

26. A container as defined in claim 25 wherein the lid has a plurality of serrated ridges.

27. A container as defined in claim 25 wherein the lid is constructed of plastic material.

28. A container as defined in claim 1, further comprising: a lid removably attached to the insert member.

29. A container as defined in claim 28 wherein the insert member has a conical lead-in portion which is aligned with the aperture and the lid is positioned over the aperture.

30. A container as defined in claim 28 wherein the lid is tethered to the insert member by way of a flexible retaining strip.

31. A container as defined in claim 28 wherein the lid is constructed of plastic material.

32. A container comprising:

a receptacle for holding liquid, the receptacle having a base portion with a bottom surface and a top portion with an opening;

an insert member attached to the top portion of the receptacle, the insert member having an outer surface, an inner surface, and an aperture; and a barrier member positioned adjacent to the inner surface of the insert member and extending downwardly into the receptacle, the barrier member having a hole formed therethrough which is at least partially aligned with the aperture of the insert member and a length which provides a gap between the barrier member and the bottom surface of the receptacle, the gap being substantially less than the distance between the inner surface of the insert member and the bottom surface of the receptacle, the gap, the hole of the barrier member, and the aperture of the insert member providing access to liquid disposed within the receptacle but substantially inhibiting egress of liquid from the receptacle when the container is tipped relative to its normal operating position.

33. A container as defined in claim 32 wherein the barrier member is constructed of absorbent sponge material.

34. A container as defined in claim 32 wherein the barrier member is constructed of solid plastic material.

35. A container as defined in claim 32 wherein the receptacle is constructed of plastic material.

36. A container as defined in claim 32 wherein the base portion of the receptacle is wider than the top portion of the receptacle.

37. A container as defined in claim 32 wherein the insert member is constructed of plastic material.

38. A container as defined in claim 32 wherein the insert member has a conical lead-in portion which is aligned with the aperture.

39. A container as defined in claim 32 wherein the insert member has a raised circular portion which receives the barrier member.

40. A container as defined in claim 32 wherein the insert member has a plurality of protrusions which engage the top portion of the receptacle.

41. A container as defined in claim 32 wherein the barrier member is adhesively affixed to the inner surface of the insert member.

42. A container as defined in claim 32 wherein the barrier member has a generally circular cross-section.

43. A container as defined in claim 32 wherein the barrier member is separated from the bottom surface of the receptacle by a holding rib.

44. A container as defined in claim 32 wherein the barrier member is separated from the bottom surface of the receptacle by a raised spacer dimple arranged on the bottom surface of the receptacle.

45. A container as defined in claim 32, further comprising: a lid removably attached to the top portion of the receptacle.

46. A container as defined in claim 45 wherein the lid is constructed of plastic material.

47. A container as defined in claim 32, further comprising: a lid removably attached to the outer surface of the insert member.

48. A container as defined in claim 47 wherein the lid is tethered to the insert member by way of a flexible retaining strip.

49. A container as defined in claim 47 wherein the lid is constructed of plastic material.

* * * * *